US008533880B1

(12) United States Patent
Stark et al.

(10) Patent No.: US 8,533,880 B1
(45) Date of Patent: Sep. 17, 2013

(54) MULTI-PURPOSE LAYOUT TOOL

(71) Applicants: Robert Barrie Stark, Pennsauken, NJ (US); Joseph J. Weishew, Oreland, PA (US)

(72) Inventors: Robert Barrie Stark, Pennsauken, NJ (US); Joseph J. Weishew, Oreland, PA (US)

( * ) Notice: Subject to any disclaimer, the term of this patent is extended or adjusted under 35 U.S.C. 154(b) by 0 days.

(21) Appl. No.: 13/736,252

(22) Filed: Jan. 8, 2013

(51) Int. Cl.
*B25F 1/04* (2006.01)

(52) U.S. Cl.
USPC ..... 7/164

(58) Field of Classification Search
USPC ..... 7/164, 163, 158, 105; 33/27.031, 33/27.032, 27.03, 42, 41, 419
See application file for complete search history.

(56) References Cited

U.S. PATENT DOCUMENTS

| | | | | |
|---|---|---|---|---|
| 2,296,279 | A * | 9/1942 | Hamilton | 33/27.03 |
| 2,553,812 | A * | 5/1951 | Cohen | 33/27.03 |
| 2,557,699 | A * | 6/1951 | Silver | 33/18.1 |
| 3,153,859 | A * | 10/1964 | Jones | 33/419 |
| 6,286,216 | B1 * | 9/2001 | Braun | 30/310 |
| 7,254,855 | B2 * | 8/2007 | McCreesh | 7/164 |
| 2002/0148127 | A1 * | 10/2002 | Dana et al. | 33/456 |

* cited by examiner

*Primary Examiner* — Robert Scruggs
(74) *Attorney, Agent, or Firm* — Stuart M. Goldstein

(57) ABSTRACT

A multi-purpose layout tool has an elongated main body component and a slide block component. Each component is designed to be used separately or in combination to perform a multitude of functions. An elongated opening extends substantially the length of the main body. The opening is configured to accept a slide block guide member extending from the slide block, which is secured within the opening by a threaded knob. The slide block can be adjustably secured within the opening, at designated angles in relation to the main body. The slide block also has a number of features, including dual level members and a compass pin which is used in conjunction with the main body for circular measurement, layout, and marking.

17 Claims, 9 Drawing Sheets

MULTI-PURPOSE LAYOUT TOOL

BACKGROUND OF THE INVENTION

Numerous different hand tools are used in the carpentry and similar construction trades. Skilled workers in these trades traditionally transport heavy tool boxes for storing the tools to their worksites. Along with basic tools such as hammers, screwdrivers, pliers, etc., workers and, in particular carpenters and workers who do framing, routinely require the use of layout tools, e.g. T-squares, variable angle squares, levels, measurement components for marking construction materials such as wood, metal, dry wall and plastic, circular compass drawing devices, spacing members, etc. Storage of these individual tools in a tool box naturally increases the weight of the tool box during transport. It also costs the worker valuable time in searching for a specific tool in the tool box. And given the many tools which are utilized in a particular job, it is virtually impossible to maintain all necessary tools on a work belt or otherwise on the worker's person.

There have been various attempts to combine hand tools used for layout functions into a single unit. However, all prior combination devices have significant deficiencies. For instance, many of these devices lack significant tool components, such as levels, compass elements, or the ability to measure and mark different material stock. Other such combination devices are heavy or otherwise cumbersome to use. Most of these prior tools cannot be readily carried on the worker's person. No current layout tool combines tool features which result in a high degree of versatility, while providing a compact, readily portable unit which is easily and efficiently configured for immediate use and a multitude of functions.

SUMMARY OF THE INVENTION

It is thus the object of the present invention to provide a multi-purpose layout hand tool which overcomes the disadvantages and limitations of existing hand tool combinations.

It is the object of the present invention to provide a layout tool which utilizes two primary components, configured to be used alone or connected in combination, to perform a variety of carpentry, framing, marking, layout, measurement, and like functions.

These and other objects of the invention are accomplished by a multi-purpose layout tool comprising an elongated main body component and a slide block component. Each component is designed to be used separately or in combination to perform a multitude of functions. An elongated opening extends substantially the length of the main body. The opening is configured to accept a slide block guide member extending from the slide block, which is secured within the opening by a threaded knob. The slide block can be adjustably secured within the opening, at designated angles in relation to the main body. The slide block also has a number of features, including dual level members and a compass pin which is used in conjunction with the main body for circular measurement, layout, and marking.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
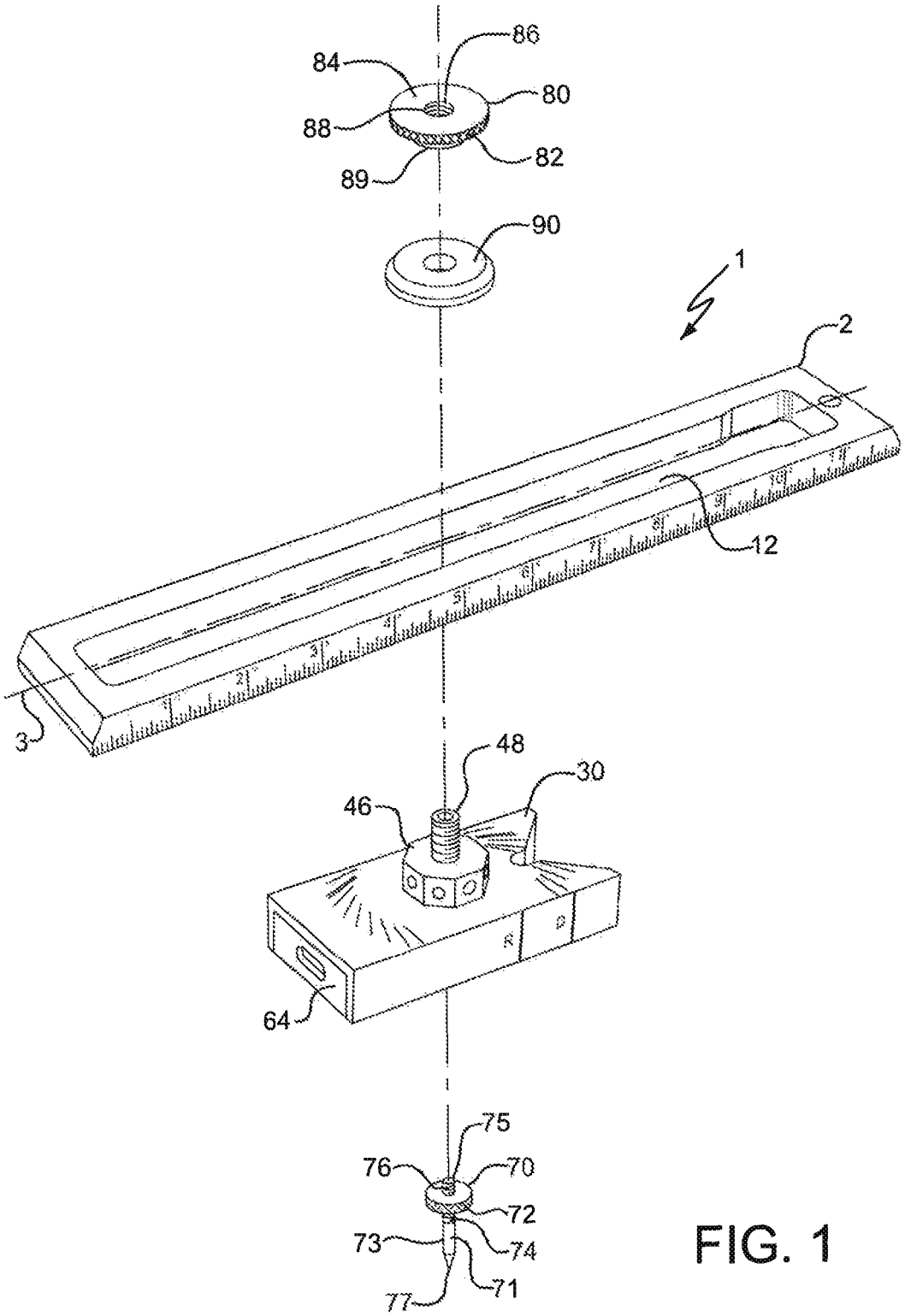
FIG. 1 is an exploded isometric view of the components of the layout tool of the present invention.
Figure 2:
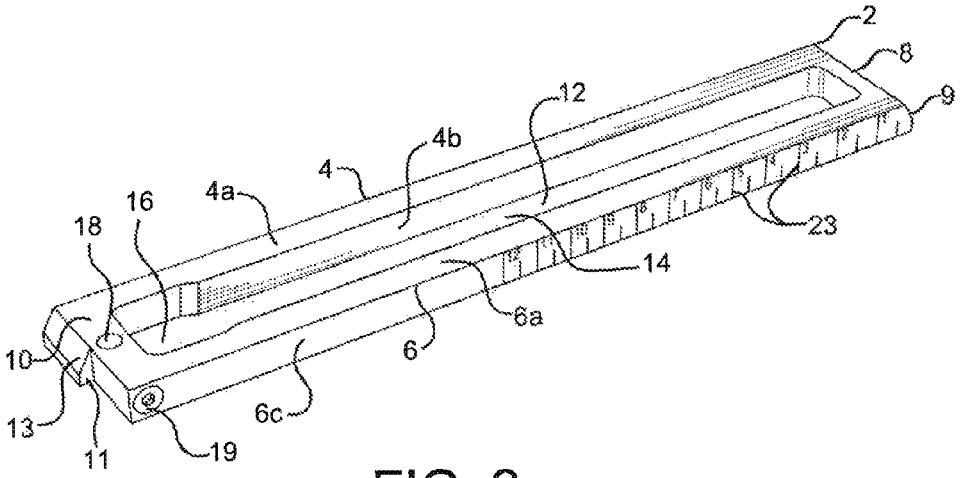
FIG. 2 is a top isometric view of the main body component of the present invention.
Figure 3:
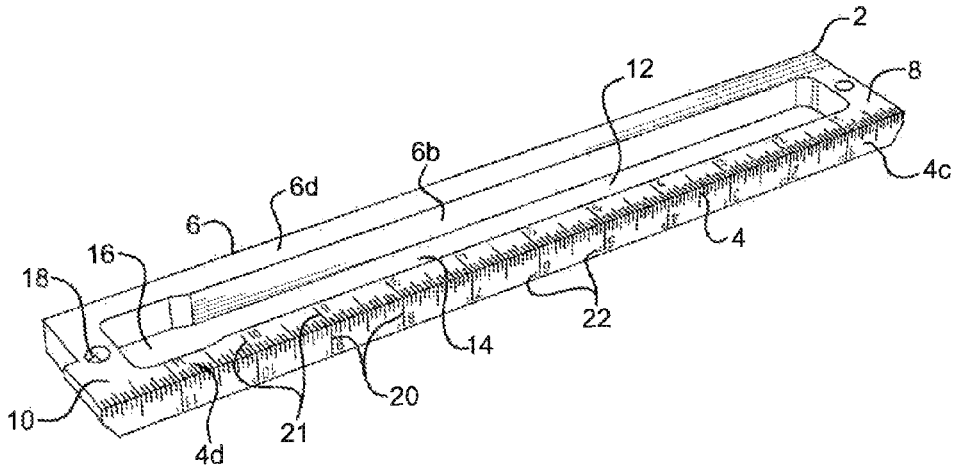
FIG. 3 is a bottom isometric view of the main body component of the present invention.
Figure 4:
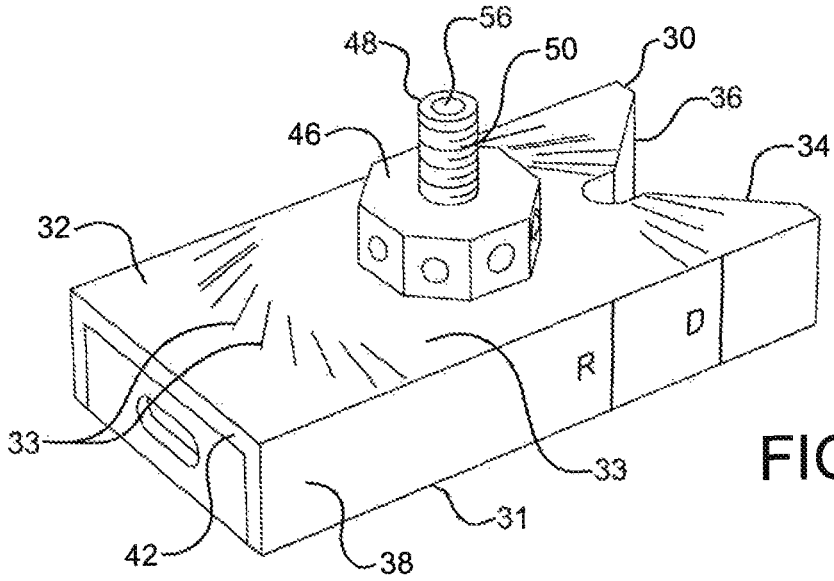
FIG. 4 is a top isometric view of the slide block component of the present invention.
Figure 5:
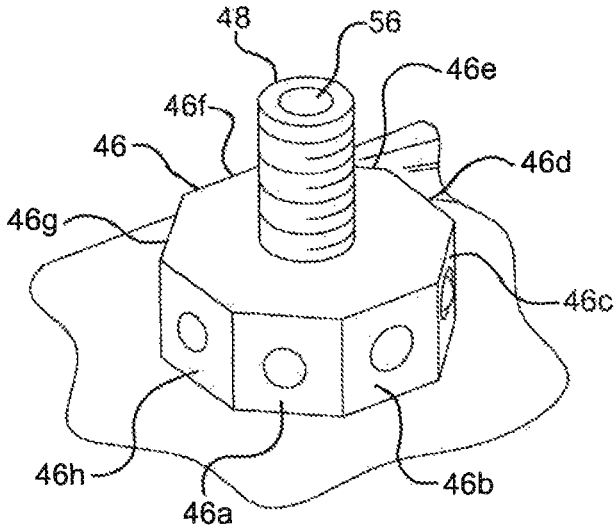
FIG. 5 is a top, close-up isometric view of a section of the slide block component of the present invention.
Figure 6:
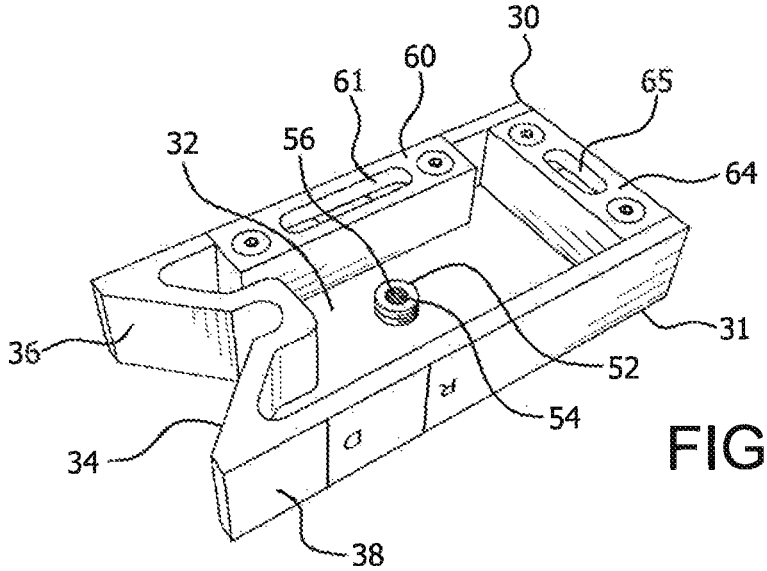
FIG. 6 is a bottom isometric view of the slide block component of the present invention.
Figure 7:
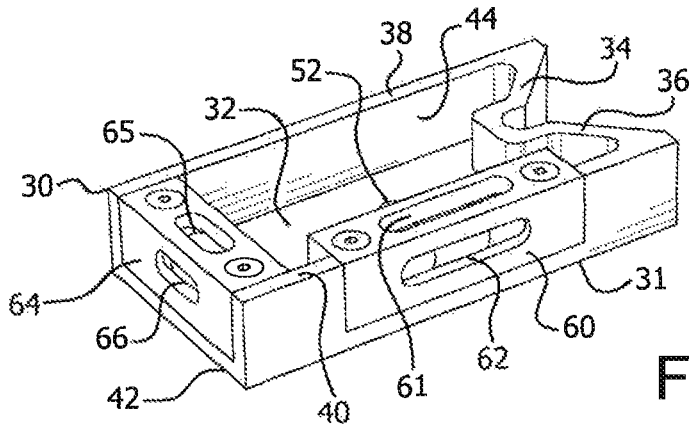
FIG. 7 is a bottom isometric view showing the other side of the slide block component of the present invention.

Layout tool 1 comprises five basic components, main body 2, slide block 30, compass pin 70, knob 80, and washer 90.

Main body 2 is an elongated unitary member, shown in the FIGs. as being twelve inches in length and two inches wide, having longitudinal axis 3. Main body 2 comprises first elongated lateral section 4 with smooth top surface 4*a*, inside surface 4*b*, outside surface 4*c*, and smooth bottom surface 4*d*; second elongated lateral section 6 with smooth top surface 6*a*, inside surface 6*b*, outside surface 6*c*, and smooth bottom surface 6*d*; and end sections 8 and 10. Elongated opening 12 extends for the majority of the length of main body 2, parallel to longitudinal axis 3. First lateral section 4, second lateral section 6, and end sections 8 and 10 completely circumscribe elongated opening 12. First lateral section 4 and second lateral section 6 each have a given width, optimally one half inch.

The majority of the length of elongated opening 12 comprises open section 14, framed by inside surfaces 4*b* and 6*b*. Section 14 has a given width, optimally one inch. Section 14 opens into second section 16, this second section has a width which is greater than the width of the first section.

End section 8 of main body 2 has angled surface 9 and end section 10 of the main body has outwardly extending member 11 with angled surface 13. Hole 18 extends through end section 10 to accept a pencil 92, when tool 1 is utilized in its compass mode, as is described hereinafter. Inset screw 19 serves to secure pencil 92 in position in hole 18.

Incremental inches markings 20 on outside surface 4*c* of first lateral section 4 and markings 21 on bottom surface 4*d* are provided, representing a two way twelve inch rule. Smaller numbers 22 near markings 20 on outside surface 4*c* are provided to be utilized when tool 1 is in the compass mode. Incremental markings 23 on outside surface 6*c* of second lateral section 6 are used to determine the center of round stock from one half inch to twelve inches.

Slide block 30, an independent, separate component from main body 2, comprises base 31 having top wall 32 with smooth top surface 33, angled front walls 34 and 36, side walls 38 and 40 and rear wall 42. Slide block 30, as shown, is two inches wide by four inches long. Bottom recess 44 extends substantially the full length of slide block, beneath top wall 32. Slide guide element 46 is secured to top surface 33. Slide guide element 46 is a polygonal shaped block member and is shown in the FIGs. as being octagonal in shape, having flat sides 46*a*, 46*b*, 46*c*, 46*e*, 46*e*, 46*f*, 46*g* and 46*h*. The diameter of slide guide element 46, that is the dimension from one flat side to the diametrically opposite flat side, is just slightly less than the width of open section 14 of elongated opening 12. This slight difference in width allows main body 2 to smoothly slide transversely over top surface 33 of slide block 30 without rotation of the main body, when slide guide element 46 is inserted within open section 14 of elongated opening 12, with diametrically opposed sides of the slide guide element adjacent to inside surfaces 4*b* and 6*b* of the main body. See FIGS. 1, 9, 10 and 13.

Externally threaded member 48 comprises upper threaded section 50 extending up from slide guide element 46. Threaded member 48 extends completely through slide guide element 46 and top wall 32 of slide block 30, exiting into recess 44 as lower section 52. Threaded member 48 also has open through channel 56 which extends completely through the threaded member. Internal channel threads 54 are located within channel 56, in lower section 52.

Level element 60 is located in recess 44 of slide block 30, within side wall 40. Level element 64, positioned perpendicular to level element 60, is located in recess 44, adjacent to rear wall 42 and between side walls 38 and 40. Level element 60 comprises level windows 61 and 62 and level element 64 comprises level widows 65 and 66.

Markings "R" and "D" are provided on the surface of side wall 38 of slide block 30. These are used for the compass function and to indicate diameter when tool 1 is used with round stock.

Compass pin 70 comprises elongated shaft 71 on which knurled handle 72 is secured. Pin section 73 of shaft 71 has threads 74 which extend partly along the shaft, adjacent to and on one side of handle 72. Thread section 75 of shaft 71 has threads 76 which extend along the shaft adjacent to and on the other side of handle 72. Shaft 71 has pointed end 77.

When tool 1 is used for any function other than its compass function, pin section 73 of shaft 71 of compass pin 70 is inserted into through channel 56 of threaded member 48. Compass pin 70 is secured and stored in this position, with its shaft 71 located within channel 56 of threaded member 48, by the threadable engagement of threads 74 along shaft 71 and internal channel threads 54, located within thread section 52 of the threaded member. See FIGS. 6, 7, 9-12.

Figure 8:
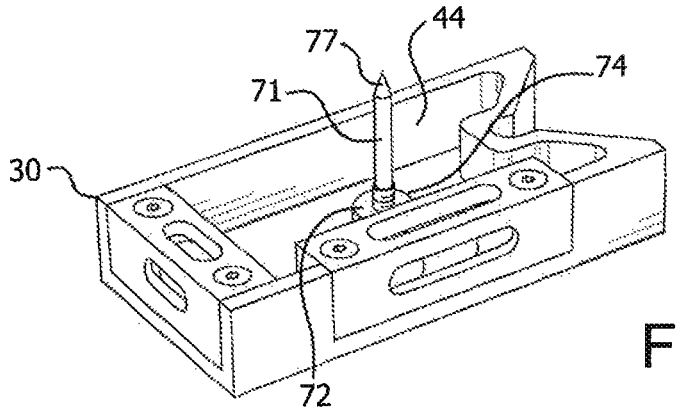
FIG. 8 is a bottom isometric view of the slide block component of the present invention in the compass mode.
Figure 9:
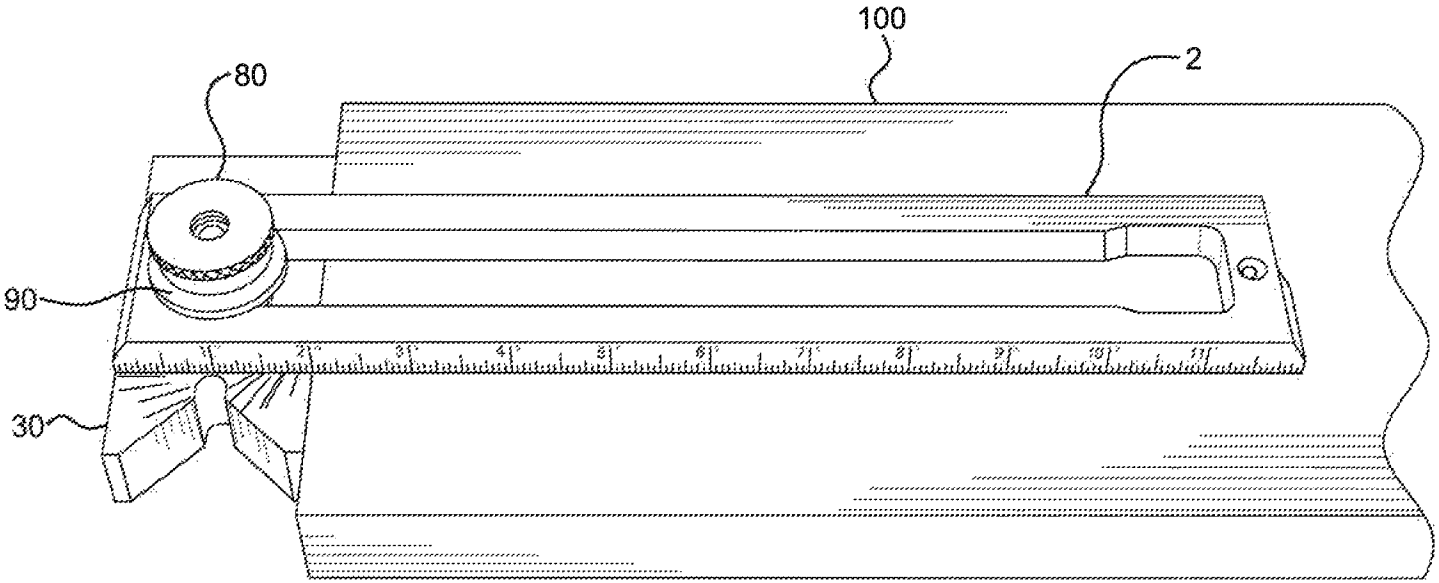
FIG. 9 is a view of the present invention functioning as a T-square.
Figure 10:
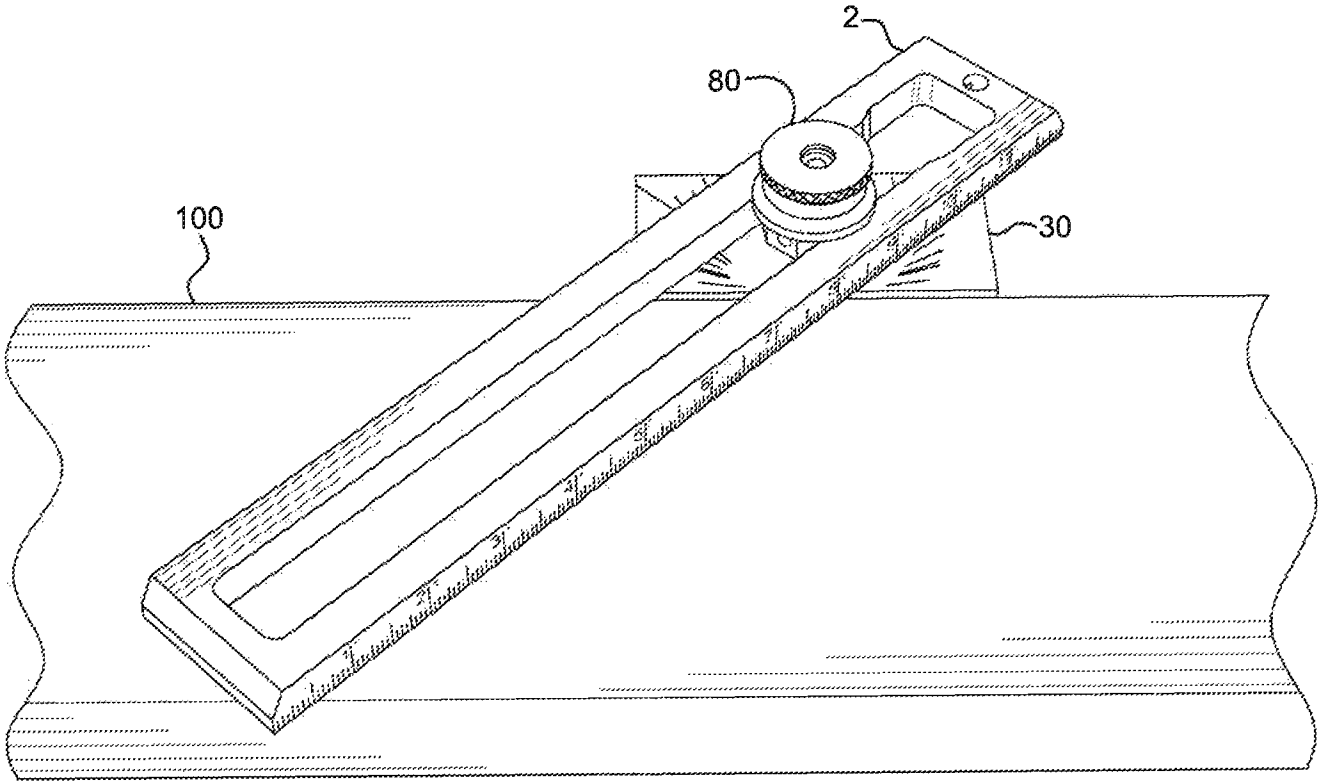
FIG. 10 is a view of the present invention functioning as a 45° angle square.
Figure 11:
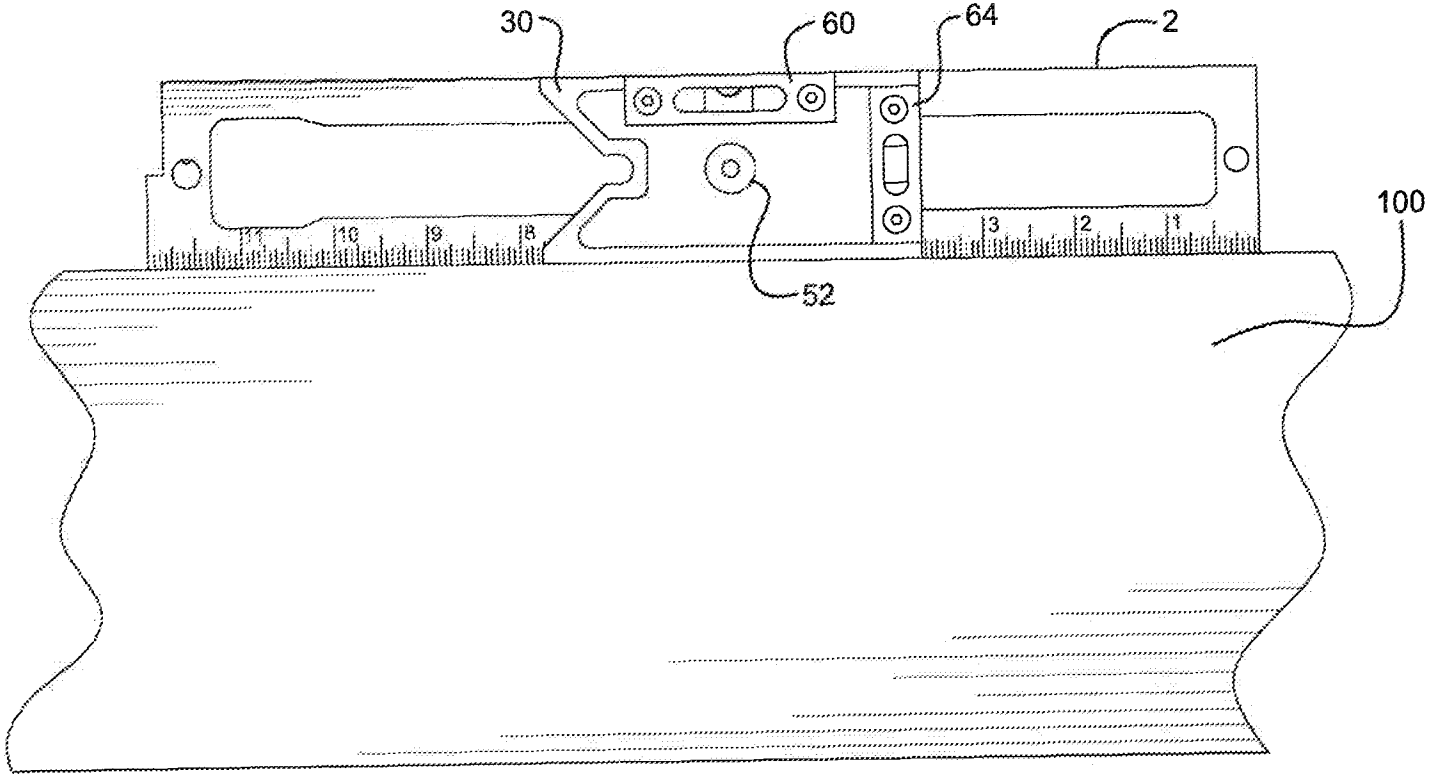
FIG. 11 is a view of the present invention functioning as a horizontal level.
Figure 12:
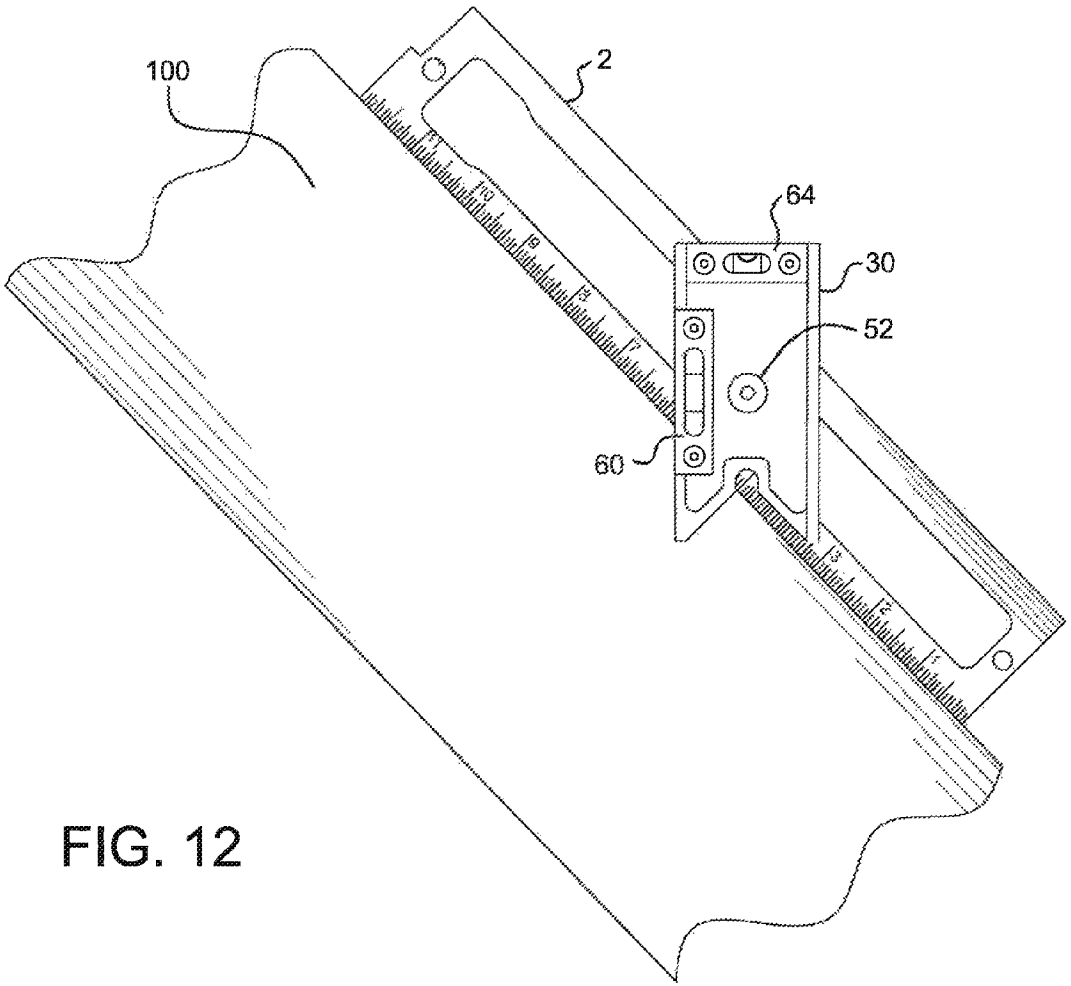
FIG. 12 is a view of the present invention functioning as a 45° level.

When tool 1 is to be used for its compass function, threads 74 of compass pin 70 are threadably unscrewed from internal channel threads 54 and compass pin 70 is removed from threaded member 48. Compass pin 70 is then rotated 180° and threads 76 of thread section 75 are screwed into internal channel threads 54 of threaded member 48, to allow shaft 71 and its pointed end 77 to extend out from the threaded member. See FIGS. 8 and 13.

Knob 80 has outer knurled surface 82, top surface 84, through opening 86 with internal threads 88, and lower base section 89. Threads 88 are configured to threadably engage upper threaded section 50 of threaded member 48 when main body 2 is to be connected with and secured to slide block 30.

Main body 2 and slide block 30, being separate and independent components, can be used separately for different layout functions, as described hereinafter. However, these components are also designed to be connected in order to greatly increase the versatility of tool 1. Connection of main body 2 and slide block 30 is accomplished by positioning the slide block with its top surface 33 face up, inserting slide guide element 46 into open section 16 of elongated opening 12, aligning diametrically opposite sides, e.g. sides 46*a* and 46*e*, parallel to inside surfaces 4*b* and 6*b* and sliding the main body over top surface 33 of the slide block to the desired location within open section 14 of the elongated opening. Protective washer 90 is then positioned over threaded member 48, onto first lateral section 4 and second lateral section 6 of main body 2. Knob 80 is next positioned over and screwed, by hand, onto threaded section 50 of threaded member 48, until it is snug against washer 90.

In this manner, main body 2 can be positioned and secured directly over slide block 30, or as seen in FIGS. 9-13, it can be set and secured at a specific location over or at an angle to the slide block, by aligning different diametrically opposite sides of slide guide member adjacent to inside surfaces 4*b* and 6*b*. Incremental markings 35 on top surface 33 of slide block 30 provide visual indicators of such available angles.

Tool 1 of the present invention is a very versatile device. The below listing of the tool's functions is provided only as selected examples, and is not to be considered inclusive of all the ways the tool can be used.

Figure 13:
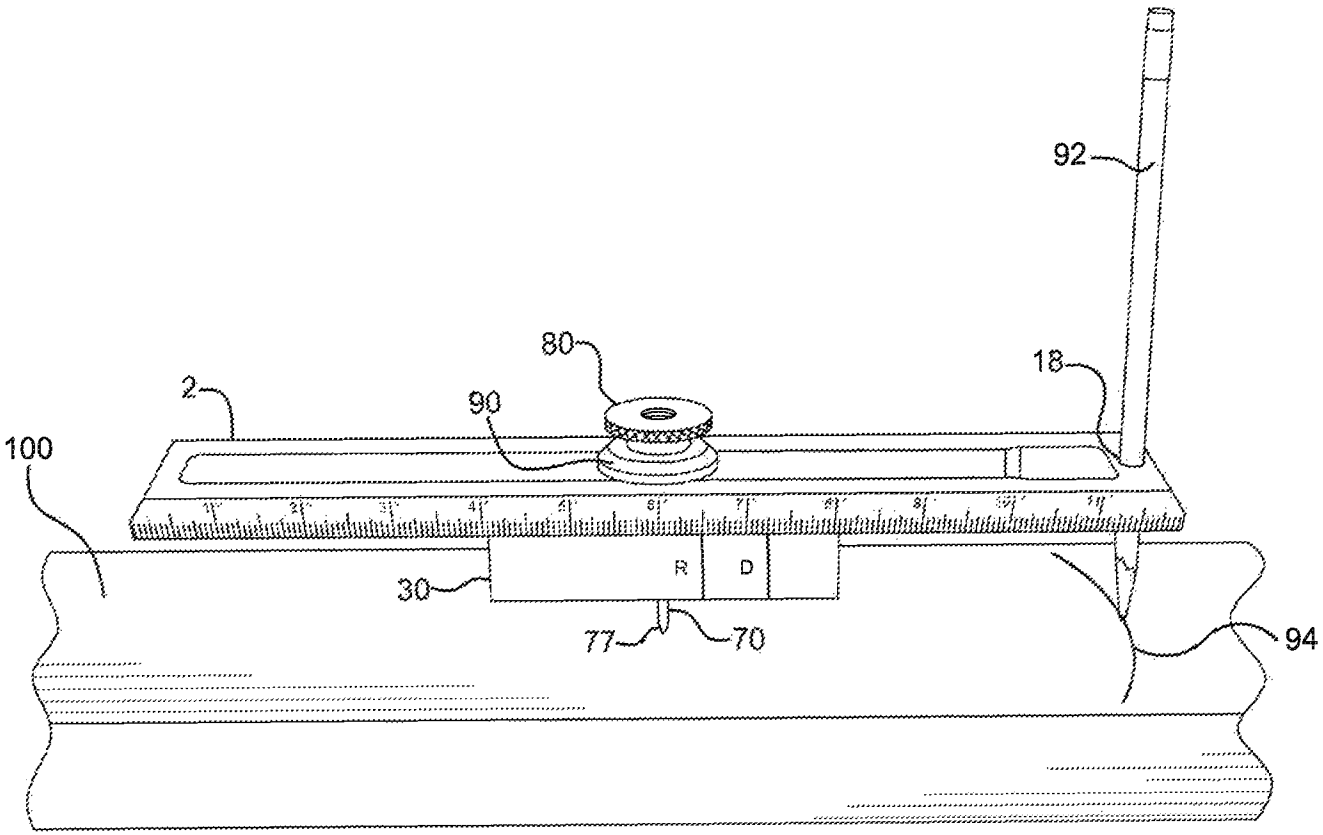
FIG. 13 shows the present invention functioning as a compass/trammel device.

Main body 2 can be used separately as follows:

- as a straight edge for drawing lines
- as a twelve inch ruler
- as a precise tool for designating measurements of one half inch, one inch, and two inches, since the first and second lateral sections 4 and 6 are each one half inch wide and the elongated opening is one inch wide Slide block 30 can be used separately as follows:

- as both a horizontal and vertical level, by positioning the slide block on its side, end, or, with knob 80 attached, inverted, with top surface 84 of the knob resting on a small surface
- as a precise tool for designating measurements of two inches and four inches, the width and length of the slide block
- as a straight edge Main body 2 secured to slide block 30 by knob 80 can be used in combination as follows:

- as an adjustable T-square on stock 100. See FIG. 9
- as an angle square, capable of being set at various angles. See FIG. 10
- as a horizontal and vertical level, capable of placement in different positions. See FIG. 11
- as a forty-five degree level. See FIG. 12
- for depth gauge measurement. See FIG. 9
- as a compass. By securing pencil 92 in hole 18 of main body 2 and setting pointed end 77 of compass pin 70, a circle 94 of any measured radius up to twelve inches can be drawn. FIG. 13 shows a five and a half inch radius circle being drawn.
- as a compass trammel
- for measuring round stock, including determining the radius and marking the centers of round stock When all components of tool 1 are assembled, the unit becomes a compact, self-contained, integral device. Its primary components, main body 2 and slide block 30, are fabricated of lightweight steel. It is thus configured to be stored in a case which, when provided with a strap, can easily be carried on the worker's belt or tool belt so that it is readily accessible for use.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A layout tool having a plurality of functions comprising:

an independent, separate, elongated main body component having a longitudinal axis, said main body component comprising two lateral sections and two end sections and an elongated opening extending parallel to the longitudinal axis and substantially the length of the main body component, between the end and lateral sections, the end and lateral sections completely circumscribing and enclosing the opening;

an independent, separate slide block component comprising a slide base having side walls and a top wall with a top surface, a slide guide element secured to the top surface, said slide guide element being smaller in size than the slide block component and configured to be inserted, in its entirety, into the opening, the slide guide element being located between the sidewalls and having flat sides positioned directly on and extending up from the top surface of the slide base of the slide block component, and a threaded member extending through the slide guide element and the top wall;

a knob having threads configured to threadably engage the threaded member, whereby when independent and separated from each other, the main body component and slide block component are each used separately for a plurality of different functions and when the slide guide element of the slide block component is inserted in its entirety into the elongated opening of the main body component and the knob is threadably engaged with the threaded member, the assembled tool is used for a plurality of other functions; and a compass pin having a shaft and a handle, a thread section extending from one side of the handle and a pin section extending from the other side of the handle, the pin section comprising threads at one end of the pin section and a point at the other end, and wherein the threaded member comprises a through channel having internal threads, whereby when the tool is in a compass mode, the thread section is threadably engaged with the internal threads of the channel and when the tool is not in the compass mode, the threads of the pin section are threadably engaged within the internal threads of the channel.

2. The layout tool as in claim 1 wherein the elongated opening comprises two open sections, the first open section having a uniform width extending for the majority of the length of the elongated opening and a second open section adjacent to the first open section and located at one end of the main body, said open second section being wider than the first open section.

3. The layout tool as in claim 1 wherein each lateral section has a top surface, a bottom surface, and two side surfaces extending between the top and bottom surfaces.

4. The layout tool as in claim 3 further comprising incremental measurement markings on side surfaces of the lateral sections.

5. The layout tool as in claim 1 wherein each lateral section comprises a top surface, a bottom surface, and two side surfaces extending between the top and bottom surfaces and wherein the slide guide element of the slide block component is polygonal in shape, having at least four side walls, the side block component being slideable within the elongated opening along two diametrically opposite side walls of the slide guide element when the slide guide element is inserted into the elongated opening of the main body component and the knob is threadably engaged with the threaded member.

6. The layout tool as in claim 5 further comprising a recess beneath the top wall of the slide block component.

7. The layout tool as in claim 6 further comprising at least one level element located within the recess.

8. The layout tool as in claim 1 wherein the slide guide element of the slide block component is polygonal in shape, having at least four side walls, the side block component being slideable within the elongated opening along two diametrically opposed side walls of the slide guide element when the slide guide element is inserted into the elongated opening of the main body component and the knob is threadably engaged with the threaded member.

9. The layout tool as in claim 8 wherein the slide block component has a plurality of angled markings on its top surface to locate the main body component at a plurality of angles in relation to the slide block component.

10. The layout tool as in claim 8 further comprising a recess beneath the top wall of the slide block component.

11. The layout tool as in claim 10 further comprising at least one level element located within the recess.

12. The layout tool as in claim 10 further comprising one level element positioned perpendicularly to a second level element within the recess.

13. The layout tool as in claim 1 wherein the slide block component has two ends, one of the ends having side walls angled in relation to each other.

14. The layout tool as in claim 1 further comprising a washer component positioned between the knob and the main body component when the slide guide element of the slide block component is inserted into the elongated opening of the main body component and the knob is threadably engaged with the threaded member.

15. A layout tool having a plurality of functions comprising:

an independent, separate, elongated main body component having a longitudinal axis, said main body component comprising:

a first lateral section, a second lateral section, and two end sections; and an elongated opening extending substantially the length of the main body component and parallel to the longitudinal axis, the first lateral, second lateral, and end sections totally circumscribing the elongated opening;

an independent, separate slide block component having side walls, a top wall and a top surface, said slide block component comprising:

a slide guide element secured to the top surface of the slide block, said slide guide element being smaller in size than the slide block component and configured to be inserted, in its entirety, into the opening, the slide guide element being located between the sidewalls and having flat sides positioned directly on and extending up from the top surface of the slide block component;

a threaded member extending through the slide guide element and the top wall;

a recess beneath the top wall of the slide block component, the threaded member extending into the recess;

a compass pin having a shaft with a pointed end and a handle, wherein said compass pin comprises a thread section extending from one side of the handle and a pin section extending from the other side of the handle, the pin section comprising threads at one end of the pin section and a point at the other end, and wherein the threaded member comprises a through channel having interior threads, whereby when the tool is in a compass mode, the thread section is threadably engaged with the interior threads of the channel and when the tool is not in the compass mode, the threads of the pin section are threadably engaged with the interior threads of the channel; and a knob having threads configured to threadably engage the threaded member, whereby when separated from each other, the main body component and the slide block component are each used separately to perform a plurality of different functions and when the slide guide element of the slide block component is inserted in its entirety into the elongated opening of the main body component and the knob is threadably engaged with the threaded member, the tool is used to perform a plurality of other functions.

16. The layout tool as in claim 15 wherein the elongated opening comprises two open sections, the first open section having a uniform width extending for the majority of the length of the elongated opening and a second open section adjacent to the first open section, said second open section being wider than the first open section.

17. The layout tool as in claim 15 further comprising at least one level element located within the recess.

* * * * *